US007778571B2

(12) United States Patent
Noh et al.

(10) Patent No.: US 7,778,571 B2
(45) Date of Patent: Aug. 17, 2010

(54) MANUFACTURING METHOD OF DEVELOPING UNIT, DEVELOPING UNIT, AND IMAGE FORMING DEVICE

(75) Inventors: Joo-hwan Noh, Yongin-si (KR); Young-min Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 930 days.

(21) Appl. No.: 11/402,875

(22) Filed: Apr. 13, 2006

(65) Prior Publication Data

US 2006/0239713 A1 Oct. 26, 2006

(30) Foreign Application Priority Data

Apr. 21, 2005 (KR) ..... 10-2005-0033106

(51) Int. Cl.
*G03G 21/18* (2006.01)

(52) U.S. Cl. ..... 399/113; 399/111; 399/346

(58) Field of Classification Search ..... 399/113, 399/111, 119, 120, 123, 345, 350, 346
See application file for complete search history.

(56) References Cited

U.S. PATENT DOCUMENTS

| | | | | |
|---|---|---|---|---|
| 4,702,591 | A * | 10/1987 | Tsuda et al. | 399/345 |
| 5,111,244 | A * | 5/1992 | Koyama et al. | 399/111 |
| 5,211,864 | A * | 5/1993 | Godlove | 508/583 |
| 5,697,038 | A | 12/1997 | Hatta et al. | |
| 5,828,928 | A * | 10/1998 | Sasago et al. | 399/111 |
| 6,163,665 | A | 12/2000 | Watanabe et al. | |
| 6,741,829 | B2 | 5/2004 | Stickler et al. | |

* cited by examiner

*Primary Examiner*—David P Porta
*Assistant Examiner*—Bryan P Ready
(74) *Attorney, Agent, or Firm*—Staas & Halsey LLP

(57) ABSTRACT

A manufacturing method of a developing unit including an OPC (organic photoconductor), a cleaning member disposed at a cleaning position in a predetermined radial direction of the OPC to clean the OPC, and a frame on which the OPC and the cleaning member are mounted. The method includes mounting the OPC on the frame to rotate in a predetermined operating direction, and mounting the cleaning member on the frame so that the cleaning member is moved toward and disposed at the cleaning position in a direction that is substantially the same as the operating direction of the OPC in a vicinity of the cleaning position.

16 Claims, 5 Drawing Sheets

MANUFACTURING METHOD OF DEVELOPING UNIT, DEVELOPING UNIT, AND IMAGE FORMING DEVICE

CROSS-REFERENCE TO RELATED APPLICATIONS

This application claims the benefit of Korean Patent Application 2005-33106 filed on Apr. 21, 2005, in the Korean Intellectual Property Office, the disclosure of which is incorporated herein by reference.

BACKGROUND OF THE INVENTION

1. Field of the Invention

An aspect of the present invention relates to a manufacturing method of a developing unit, a developing unit, and an image forming device, and more particularly, to a manufacturing method of a developing unit, a developing unit, and an image forming device improving a disposing process of a cleaning member.

2. Description of the Related Art

Conventionally, an image forming device includes a feeder, a developing unit, a fixing unit, and a discharge unit. The feeder supplies printing paper into the developing unit, and then the developing unit selectively applies developer to the printing paper to form an image. The fixing unit fixes the applied developer on the printing paper. The discharge unit receives the printing paper with the fixed developer from the fixing unit and discharges it to the outside.

FIG. 1 is a schematic view illustrating a conventional developing unit 100. As shown in FIG. 1, the developing unit 100 includes an organic photoconductor (OPC) 110, a developing roller 111, a cleaning member 120, and a charging roller 117. The OPC 110 receives light from a light emitting unit (not shown) and forms a latent image. The developing roller 111 applies developer to the OPC 110 and develops the latent image on the OPC 110. The developer applied to the OPC 110 is transferred to printing paper (not shown) by a transfer roller (not shown).

The cleaning member 120 is disposed at a cleaning position which is located between the transfer roller (not shown) of the OPC 110 and the charging roller 117 in a predetermined radial direction of the OPC 110, and cleans any residual developer remaining on the OPC 110 after the developer on the OPC 110 is transferred to the printing paper. The cleaned residual developer is collected by a waste developer collecting part 144. The charging roller 117 applies an electric charge to the OPC 110 so that the OPC 110 has a uniform electric potential. A supplying roller 113 supplies the developer from a developer storage part 114 to the developing roller 111. An agitator 115 mixes the developer and facilitates supply of the developer to the supplying roller 113. A doctor blade 116 controls an amount of the developer applied by the developing roller 111 to the OPC 110.

The developing unit 100 includes a main frame 130 and a cleaning frame 140. The main frame 130 rotatably supports the OPC 110, the developing roller 111, the supplying roller 113, and the agitator 115, and fixedly supports the doctor blade 116. The cleaning frame 140 supports the cleaning member 120 to enable the cleaning member 120 to clean the OPC 110, and rotatably supports the charging roller 117.

FIG. 2 is a schematic view illustrating a manufacturing method of the developing unit 100 of FIG. 1. As shown in FIGS. 1 and 2, in a conventional manufacturing method of the conventional developing unit 100, the OPC 110 is rotatably supported by the main frame 130 to rotate in a predetermined operating direction (R) and the cleaning frame 140 supports the cleaning member 120 with a lubricant (A) being applied to a portion of the cleaning member 120 facing the OPC 110. The cleaning frame 140 is coupled to the main frame 130 so that the cleaning member 140 is disposed at the cleaning position in the predetermined radial direction of the OPC 110. The lubricant (A) reduces friction between the cleaning member 120 and the OPC 110 the first time the developing unit 100 is operated.

However, in the manufacturing method of the conventional developing unit 100, the cleaning member 120 is moved toward and disposed at the cleaning position in a direction (a) that is substantially opposite to the operating direction (R) of the OPC 110 when the cleaning frame 140 is coupled to the main frame 130. At this moment, in the process of disposing the cleaning member 120 at the cleaning position, the lubricant (A) applied to the cleaning member 120 adheres to the OPC 110 between the cleaning position and the charging roller 117, and then the lubricant (A) may contaminate the OPC 110.

Further, when the developing unit 100 performs a developing process for forming an image, the lubricant (A) adhered to the OPC 110 moves together with the OPC 110 as the OPC 110 rotates in the operating direction (R). Therefore, an image contaminated by the lubricant (A) may be formed on the printing paper.

More particularly, the lubricant (A) adhered to the OPC 110 may contaminate the charging roller 117. Therefore, a contaminated image containing a blemish, such as a white or black horizontal band or a black spot, may be formed on the printing paper. To prevent formation of a contaminated image caused by the contaminated charging roller 117, when the developing unit 100 is operated for the first time, a user should warm it up for hours or clean the charging roller 117. Further, to minimize the contamination of the charging roller 117, the amount of the lubricant (A) applied to the cleaning member 120 should be precisely controlled.

SUMMARY OF THE INVENTION

An aspect of the present invention relates to a manufacturing method of a developing unit, a developing unit, and an image forming device which can dispose a cleaning member to prevent formation of a contaminated image on a printing paper.

According to an aspect of the present invention, a manufacturing method of a developing unit is provided for a developing unit including an OPC (organic photoconductor), a cleaning member disposed at a cleaning position in a predetermined radial direction of the OPC to clean the OPC, and a frame on which the OPC and the cleaning member are mounted. The method includes mounting the OPC on the frame to rotate in a predetermined operating direction, and mounting the cleaning member on the frame so that the cleaning member is moved toward and disposed at the cleaning position in a direction that is substantially the same as the operating direction of the OPC.

The manufacturing method of the developing unit may further include applying a lubricant on a portion of the cleaning member facing the OPC after the mounting of the OPC on the frame and before the mounting of the cleaning member on the frame.

According to another aspect of the present invention, a developing unit includes an OPC (organic photoconductor) rotatable in a predetermined operating direction, a cleaning member disposed at a cleaning position in a predetermined radial direction of the OPC to clean the OPC, and a guiding part guiding the cleaning member so that the cleaning member is moved toward and disposed at the cleaning position in a direction that is substantially the same as the operating direction of the OPC.

The developing unit may further include a main frame on which the OPC is mounted, a cleaning frame, coupling with the main frame, on which the cleaning member is mounted. The guiding part may include a guide pin provided in one of the main frame and the cleaning frame, and a guide groove provided in another one of the main frame and the cleaning frame to receive the guide pin so that the cleaning member is moved toward and disposed at the cleaning position in a direction that is substantially the same as the operating direction of the OPC when the cleaning frame couples with the main frame.

The cleaning frame may rotatably couple with the main frame.

According to another aspect of the invention, a manufacturing method of a developing unit is provided for a developing unit including an OPC (organic photoconductor) and a cleaning member cleaning the OPC at a cleaning position. The manufacturing method includes mounting the OPC to move in a predetermined operating direction, moving the cleaning member toward the cleaning position in a direction that is substantially the same as the operating direction of the OPC in a vicinity of the cleaning position until the cleaning member reaches the cleaning position, and mounting the cleaning member at the cleaning position after the cleaning member has reached the cleaning position.

According to another aspect of the invention, a developing unit includes an OPC (organic photoconductor) movable in a predetermined operating direction, a cleaning member cleaning the OPC at a cleaning position, and a structure guiding the cleaning member toward the cleaning position in a direction that is substantially the same as the operating direction of the OPC in a vicinity of the cleaning position until the cleaning member reaches the cleaning position.

According to another aspect of the present invention, an image forming device includes any of the developing units described above.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE EMBODIMENTS

Figure 1:
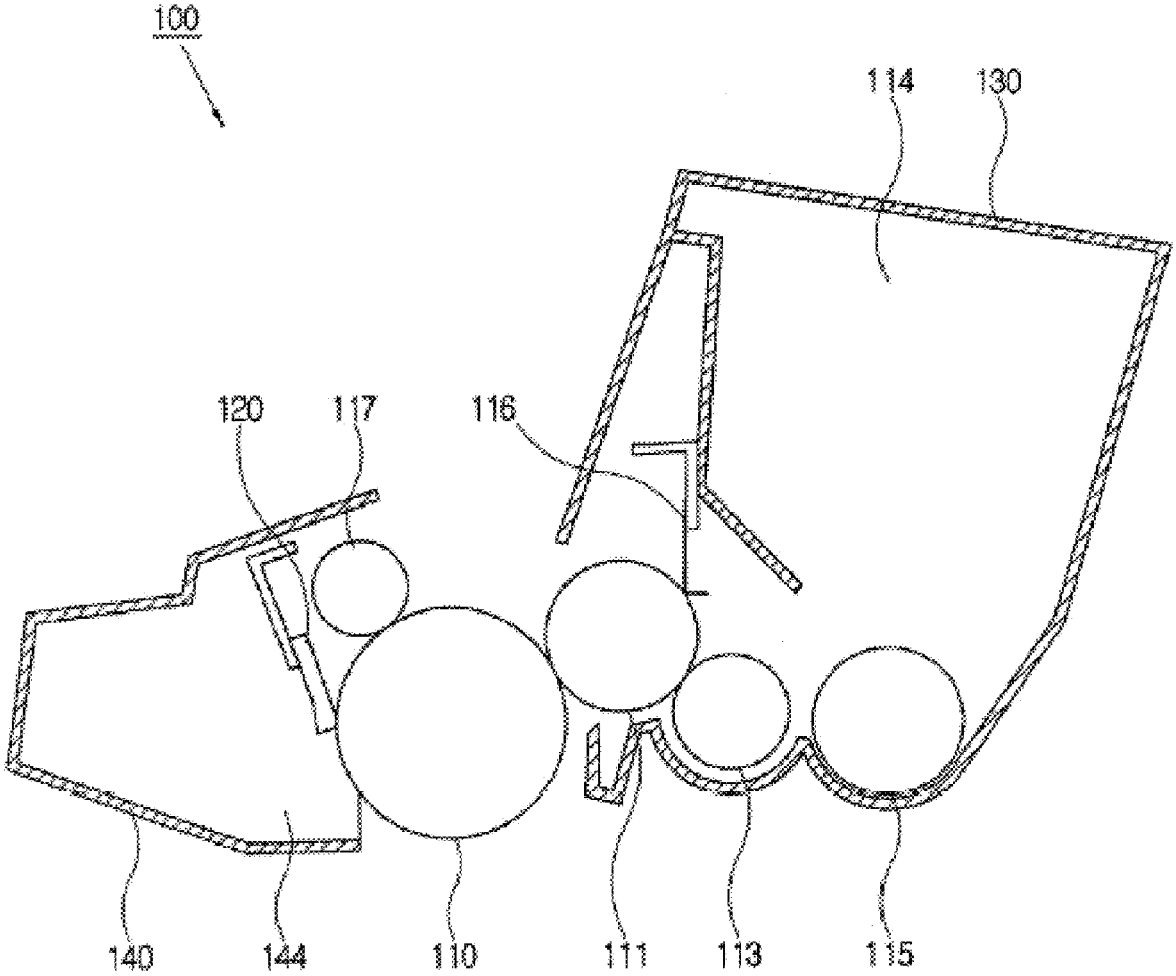
FIG. 1 is a schematic view illustrating a conventional developing unit.
Figure 2:
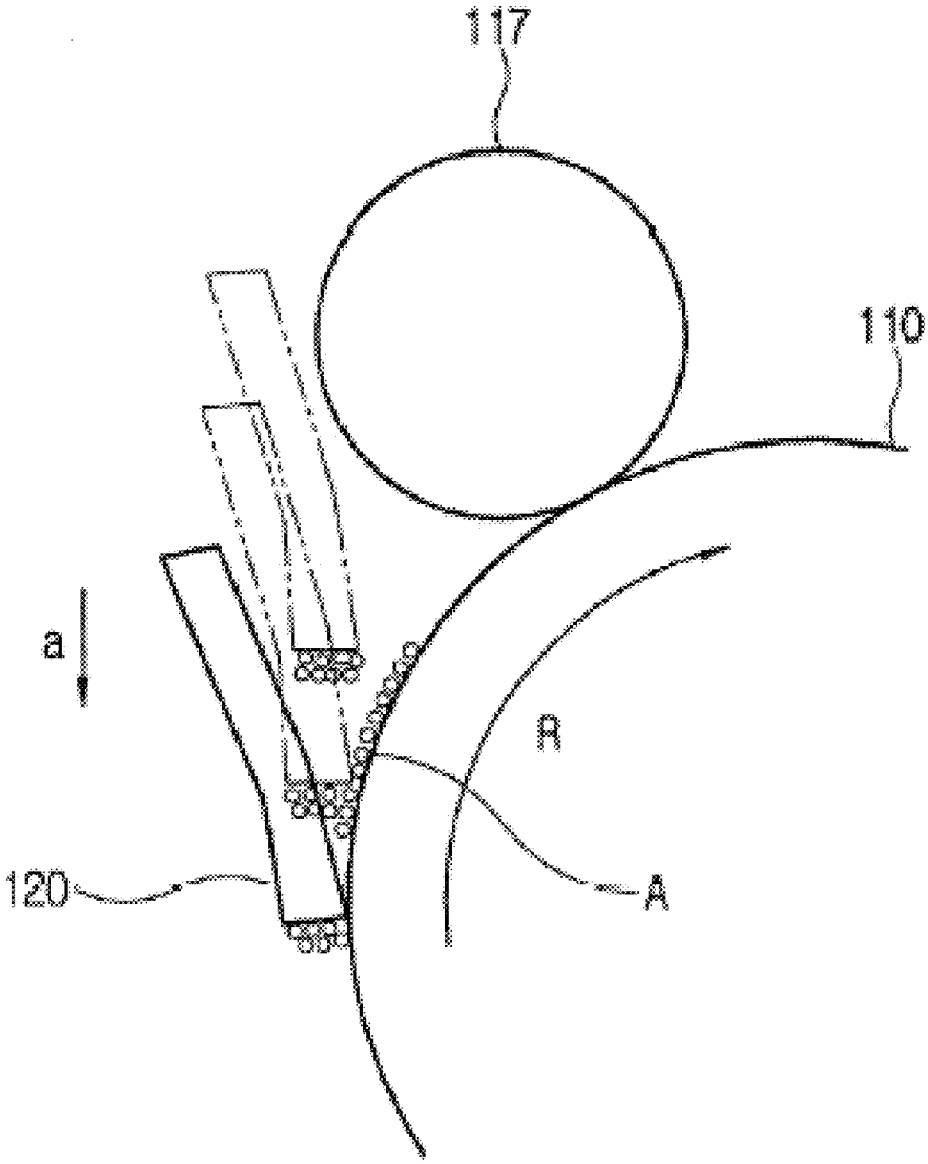
FIG. 2 is a schematic view illustrating a manufacturing method of the developing unit of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
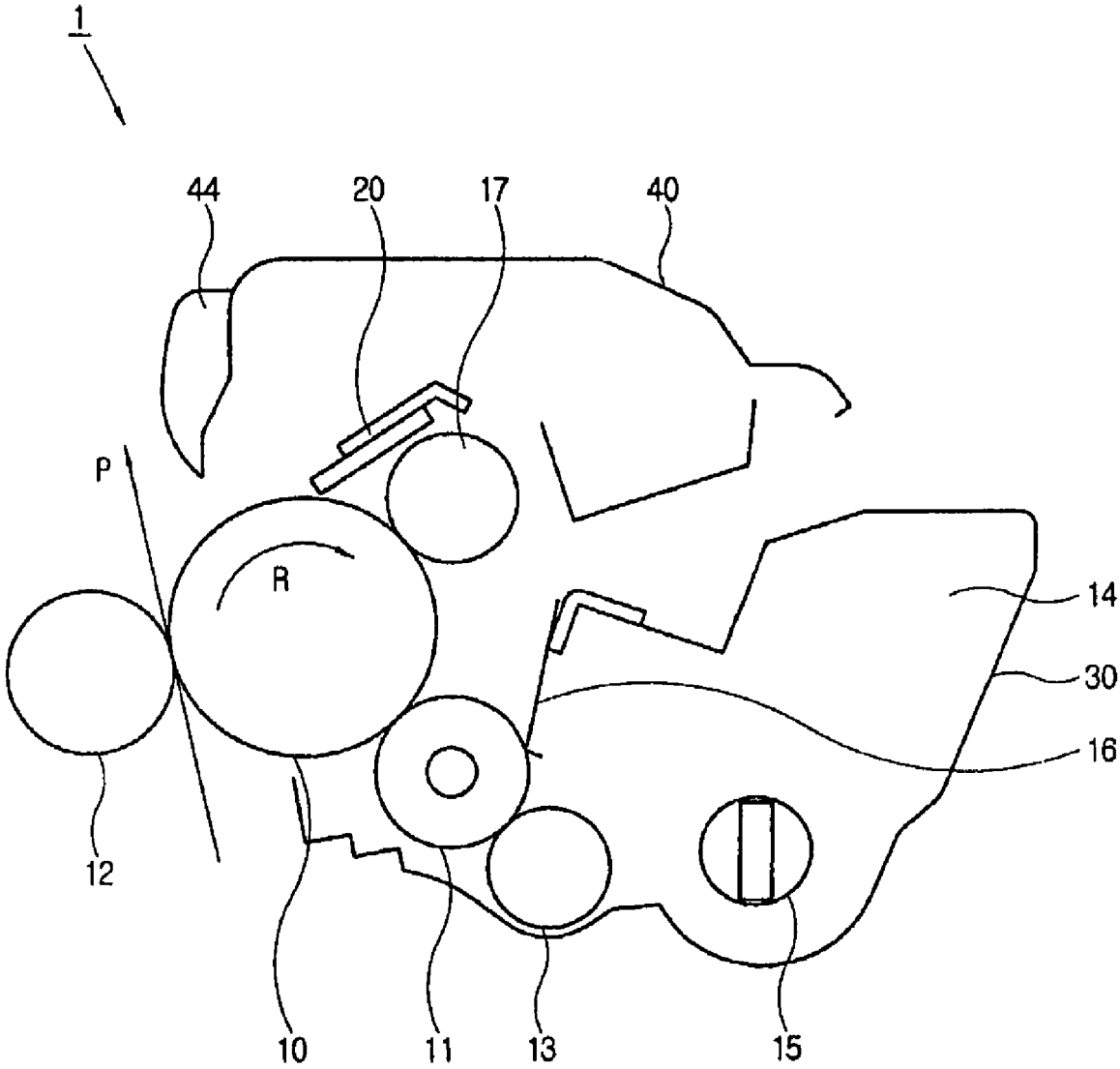
FIG. 3 is a schematic view illustrating a developing unit according to an embodiment of the present invention.
Figure 4:
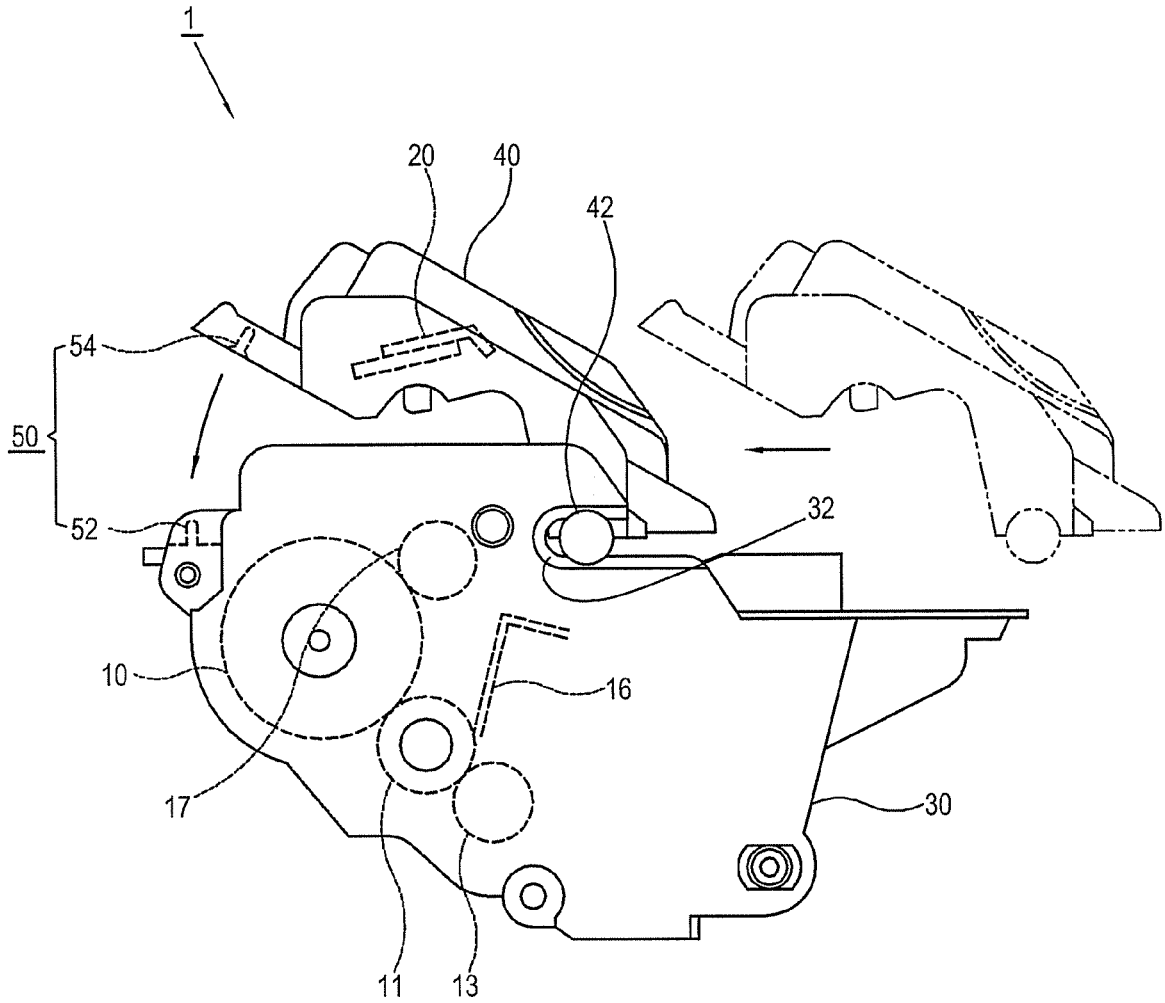
FIG. 4 is a schematic view illustrating a manufacturing method of the developing unit of FIG. 3.

FIG. 3 is a schematic view illustrating a developing unit 1 according to an embodiment of the present invention, and FIG. 4 is a schematic view illustrating a manufacturing method of the developing unit 1 of FIG. 3. As shown in FIGS. 3 and 4, the developing unit 1 includes an OPC 10, a cleaning member 20, and a guiding part 50.

The OPC 10 is made of a material that is an insulator in the dark and becomes a conductor when exposed to light, and is rotatably supported by a main frame 30 to rotate in a predetermined operating direction (R) for forming an image. As a developing process for forming the image progresses, the OPC 10 rotates in the operating direction (R) past a charging roller 17, a light emitting unit (not shown), a developing roller 11, a transfer roller 12, and the cleaning member 20 in turn. The OPC 10, the charging roller 17, the developing roller 11, the transfer roller 12, a supplying roller 13, and an agitator 15 are rotated by a driving part (not shown) at a predetermined speed.

The charging roller 17 applies an electric charge to the OPC 10 so that the OPC 10 has a uniform electric potential, and the light emitting unit (not shown) scans a light beam across the OPC 10 to form a desired image. A portion of the OPC 10 exposed to the light beam from the light emitting unit (not shown) forms an electrostatic latent image due to local changes in the uniform electric potential of the OPC 10. The developing roller 11 applies developer, which is supplied from the supplying roller 13, to the OPC 10 and develops the electrostatic latent image on the OPC 10. The transfer roller 12 applies a positive high voltage to the developer applied to the OPC 10, and makes the developer transfer to printing paper (P) which advances between the OPC 10 and the transfer roller 12. A fixing unit (not shown) fixes the developer on the printing paper with heat and pressure, thereby forming an image on the printing paper (P).

The cleaning member 20 is disposed at a predetermined radial position of the OPC 10 between the transfer roller 12 and the charging roller 17, that is, the cleaning member 20 is disposed at a predetermined cleaning position. As the developing unit 1 continues the developing process, the cleaning member 20 cleans any residual developer remaining on the OPC 10 after the developer on the OPC 10 is transferred by the transfer roller 12 to the printing paper (P). The cleaning member 20 may be a cleaning blade which contacts a surface of the OPC 10 and cleans the OPC 10 by preventing the developer applied to the surface of the OPC 10 from moving with the OPC 10 as the OPC 10 rotates.

A developer storage part 14 stores the developer, and the agitator 15 mixes the developer in the developer storage part 14 and helps deliver the developer to the supplying roller 13. A waste developer collecting part 44 collects and stores the residual developer cleaned by the cleaning member 20.

Before the cleaning member 20 is disposed at the cleaning position in the manufacturing method of the developing unit 1, a lubricant may be applied to a portion of the cleaning member 20 facing the OPC 10. The first time the developing unit 1 cycles through the developing process, the lubricant reduces friction between the cleaning member 20 and the OPC 10. The lubricant decreases a torque applied to the cleaning member by the OPC 10 and prevents the cleaning member 20 from being flipped over by the friction of the rotating OPC 10. The lubricant may be a developer such as a toner or the like, or powdered poly methyl methacrylate (PMMA) or a liquid phase of PMMA or the like.

The guiding part 50 guides the cleaning member 20 so that the cleaning member 20 moves toward the cleaning position in a direction that is substantially the same as the operating direction (R) of the OPC 10 in a vicinity of the cleaning position during the process of disposing the cleaning member 20 at the cleaning position in the predetermined radial direction of the OPC 10. Therefore, even if the lubricant applied to the cleaning member 20 adheres to the OPC 10 during the process of disposing the cleaning member 20 at the cleaning position, the lubricant will adhere to a portion of the OPC 10 between the cleaning position of the OPC 10 and the transfer roller 12. After the manufacturing of the developing unit 1 is finished and the OPC 10 is rotated in the operating direction (R) to perform the developing process, the lubricant adhered to the OPC 10 is moved directly to the cleaning position and is cleaned by the cleaning member 20 before it can adhere to the other units such the charging roller 17 and the like.

The developing unit 1 includes the main frame 30 and a cleaning frame 40. The main frame 30 rotatably supports the OPC 10 to rotate in the operating direction (R). The cleaning frame 40 couples with the main frame 30 and supports the cleaning member 20 to enable the cleaning member 20 to be disposed at the cleaning position.

The main frame 30 rotatably supports the developing roller 11, the charging roller 17, the supplying roller 13, and the agitator 15 so as to perform the developing process when the OPC 10 rotates in the operating direction (R). The main frame 30 may include the developer storage part 14 and a doctor blade 16. The cleaning frame 40 may include the waste developer collecting part 44. The charging roller 17 may be supported by the cleaning frame 40 instead of the main frame 30.

The guiding part 50 includes a guide pin 52 and a guide groove 54. The guide pin 52 is provided on the main frame 30, and the guide groove 54 is provided in a first side of the cleaning frame 40 at a position corresponding to the guide pin 52. The guide groove 54 receives the guide pin 52 so that the cleaning member 20 is moved toward and disposed at the cleaning position in a direction that is substantially the same as the operating direction (R) of the OPC 10 in a vicinity of the cleaning position when the cleaning frame 40 couples with the main frame 30 in the manufacturing of the developing unit 1.

The cleaning frame 40 may rotatably couple with the main frame 30. A second side of the cleaning frame 40 is provided with a rotating bar 42, and the main frame 30 is provided with an accommodating groove 32 to receive the rotating bar 42 and allow it to rotate. In the manufacturing of the developing unit 1, the rotating bar 42 of the cleaning frame 40 supporting the cleaning member 20 is inserted into the accommodating groove 32 of the main frame 30 supporting the OPC 10. Then, the cleaning frame 40 rotates about an axis of the rotating bar 42 inserted in the accommodating groove 32 with respect to the main frame 30 so that the cleaning member 20 is disposed at the cleaning position in the predetermined radial direction of the OPC 10. The cleaning frame 40 is rotated and the cleaning member 20 is moved toward the OPC 10 so that the guide pin 52 is received in the guide groove 54, and then the rotating position of the cleaning frame 40 is adjusted. Therefore, the cleaning member 20 is moved toward and disposed at the cleaning position in a direction that is substantially the same as the operating direction (R) of the OPC 10 in a vicinity of the cleaning position.

The cleaning frame 40 may be fixed to the main frame 30 so that the position of the cleaning frame 40 is fixed after the cleaning member 20 is disposed at the cleaning position. A conventional fixing unit such as a screw or an adhesive or the like may be used. The cleaning frame 40 may be fixed to the main frame 30 by coupling of the guide pin 52 and the guide groove 54 without using a separate fixing unit.

The guide groove 54 and the guide pin 52 may be provided in various positions and as various shapes as long as the cleaning member 20 is moved toward and disposed at the cleaning position in a direction that is substantially the same as the operating direction (R) of the OPC 10 in a vicinity of the cleaning position when the coupling of the cleaning frame 40 and the main frame 30 is adjusted. The guide groove 54 may be formed in a predetermined slant line direction. Further, the guide pin 52 may be provided on the cleaning frame 40 and the guide groove 54 may be provided in the main frame 30. The guide pin 52 and the guide groove 54 are not limited to the configuration shown in FIG. 4.

The main frame 30 and the cleaning frame 40 may be coupled by a conventional coupling method instead of the rotating method as long as the cleaning member 20 is disposed at the cleaning position in the predetermined radial direction of the OPC 10. In this method, the cleaning frame 40 is not rotated but is directly coupled to the main frame 30 so that the cleaning member 20 is disposed at the cleaning position in the predetermined radial direction of the OPC 10.

Further, the function of the guiding part 50 may be provided by the main frame 30 and the cleaning frame 40 themselves without additional elements such as the guide groove 54 and the guide pin 52 being provided. If the coupling structure and the coupling configuration of the main frame 30 and the cleaning frame 40 are designed to enable coupling in an appropriate direction, the main frame 30 and the cleaning frame 40 may be coupled so that the cleaning member 20 is moved toward and disposed at the cleaning position in a direction that is substantially the same as the operating direction (R) of the OPC 10 in a vicinity of the cleaning position without additional elements such as the guide groove 54 and the guide pin 52 being provided.

The main frame 30 and the cleaning frame 40 may be implemented as a single frame not to be separated into two parts as long as the cleaning member 20 is moved toward and disposed at the cleaning position in a direction that is substantially the same as the operating direction (R) of the OPC 10 in a vicinity of the cleaning position in the manufacturing of the developing unit 1. The single frame may support both the OPC 10 and the cleaning member 20. The single frame supports the cleaning member 20 so that the cleaning member 20 is moved toward and disposed at the cleaning position in a direction that is substantially the same as the operating direction (R) of the OPC 10 in a vicinity of the cleaning position when the cleaning member 20 is mounted on the single frame.

Figure 5A:
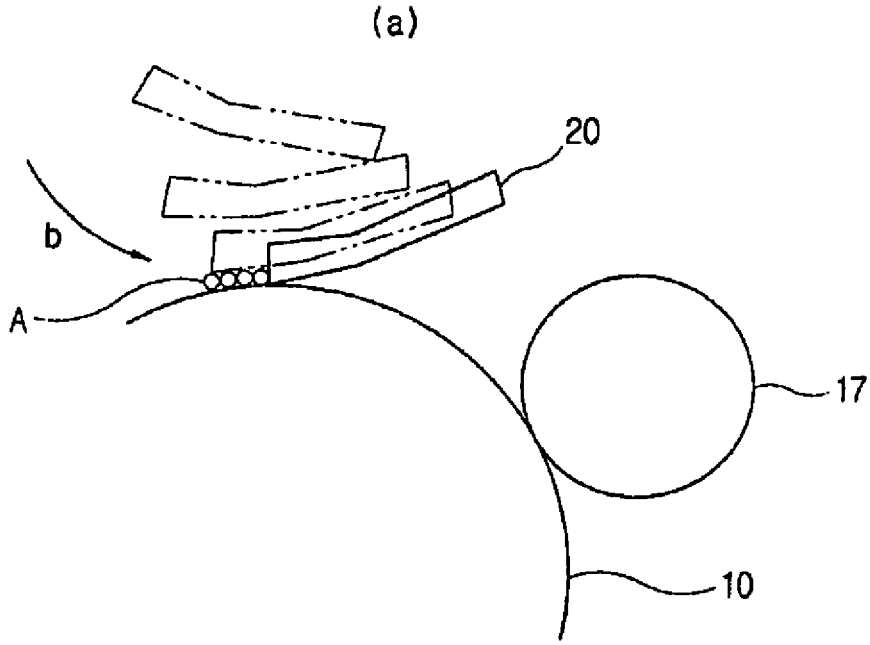
FIGS. 5A and 5B are schematic views illustrating operation of the developing unit of FIG. 3.
Figure 5B:
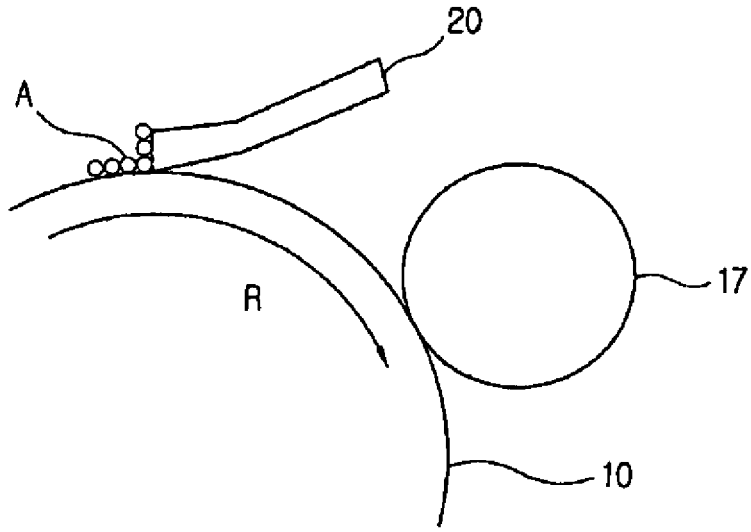

FIGS. 5A and 5B are schematic views illustrating operation of the developing unit 1 of FIG. 3. FIG. 5A illustrates the process wherein the cleaning member is disposed at the cleaning position in the predetermined radial direction of the OPC 10. FIG. 5B illustrates the process wherein the developing unit 1 performs the developing process for forming the image for the first time after manufacturing of the developing unit 1 is completed. As shown therein, in the manufacturing of the developing unit 1, the cleaning member 20 is moved toward and disposed at the cleaning position in a direction (b) that is substantially the same as the operating direction (R) of the OPC 10 in a vicinity of the cleaning position. At this moment, the lubricant (A) applied to the cleaning member 20 adheres to a portion of the OPC 10 between the cleaning position and the transfer roller (not shown).

When the manufacturing is finished and the developing unit 1 performs the developing process for the first time, the OPC 10 rotates in the operating direction (R), thereby causing the lubricant (A) adhered to the OPC 10 to move in the operating direction (R) and directly reach the cleaning position without contacting the other units such as the charging roller 17 and the like, and then the lubricant (A) adhered to the OPC 10 is cleaned by the cleaning member 20.

Therefore, in the process of disposing the cleaning member 20 at the cleaning position, the lubricant (A) adhered to the OPC 10 is intercepted by the cleaning member 20 and thus does not move past the cleaning position. Accordingly, this prevents a contaminated image from being formed on the printing paper by the lubricant (A), and prevents the charging roller 17 from being contaminated by the lubricant (A).

An image forming device according to an embodiment of the present invention includes the foregoing developing unit 1. The image forming device includes a feeder which feeds printing paper to the developing unit 1, a fixing unit which receives the printing paper with developer applied thereto and fixes the developer on the printing paper to form an image on the printing paper, and a discharge unit which discharges the printing paper with the image formed thereon to the outside.

Hereinafter, a manufacturing method of the developing unit 1 according to an embodiment of the present invention will be described with reference to FIGS. 5A and 5B. As shown in FIGS. 5A and 5B, the manufacturing method of the developing unit 1 includes providing an OPC 10, a cleaning member 20, and a frame (not shown). The cleaning member 20 is located at a cleaning position in a predetermined radial direction of the OPC 10 and cleans the OPC 10. The OPC 10 and the cleaning member 20 may be supported by the frame (not shown).

The OPC 10 is rotatably mounted on the frame (not shown) to rotate in a predetermined operating direction (R). A lubricant (A) is applied to a portion of the cleaning member 20 facing the OPC 10. The cleaning member 20 is mounted on the frame (not shown) so that the cleaning member 20 is moved toward and disposed at the cleaning position in a direction (b) that is substantially the same as the operating direction (R) of the OPC 10 in a vicinity of the cleaning position. The lubricant (A) may be applied to the cleaning member 20 before the OPC 10 is mounted on the frame (not shown), or at the same time the OPC 10 is being mounted on the frame.

Although a few embodiments of the present invention have been shown and described, it would be appreciated by those skilled in the art that changes may be made in these embodiments without departing from the principles and spirit of the invention, the scope of which is defined in the appended claims and their equivalents.

What is claimed is:

1. A manufacturing method of a developing unit comprising a photoconductor, a cleaning member disposed at a cleaning position in a radial direction of the photoconductor to clean the photoconductor, and a frame on which the photoconductor and the cleaning member are mounted, the manufacturing method comprising:

mounting the photoconductor on the frame to rotate in an operating direction; and mounting the cleaning member on the frame so that the cleaning member is moved toward and disposed at the cleaning position in a direction that is substantially the same as the operating direction of the photoconductor at the cleaning position.

2. The manufacturing method of claim 1, further comprising applying a lubricant on a portion of the cleaning member facing the photoconductor after the mounting of the photoconductor on the frame and before the mounting of the cleaning member on the frame.

3. A developing unit comprising:

a photoconductor rotatable in an operating direction;

a cleaning member disposed at a cleaning position in a radial direction of the photoconductor to clean the photoconductor;

a guiding part guiding the cleaning member so that the cleaning member is moved toward and disposed at the cleaning position in a direction that is substantially the same as the operating direction of the photoconductor;

a main frame on which the photoconductor is mounted; and a cleaning frame, coupling with the main frame, on which the cleaning member is mounted;

wherein the guiding part comprises a guide pin provided in one of the main frame and the cleaning frame, and a guide groove provided in another one of the main frame and the cleaning frame, to receive the guide pin so that the cleaning member is moved toward and disposed at the cleaning position in a direction that is substantially the same as the operating direction of the photoconductor when the cleaning frame couples with the main frame.

4. The developing unit of claim 3, wherein the cleaning frame rotatably couples with the main frame.

5. An image forming device comprising the developing unit of claim 4.

6. An image forming device comprising the developing unit of claim 3.

7. A manufacturing method of a developing unit, the developing unit comprising a photoconductor and a cleaning member cleaning the photoconductor at a cleaning position, the manufacturing method comprising:

mounting the photoconductor to move in an operating direction;

moving the cleaning member toward the cleaning position in a direction that is substantially the same as the operating direction of the photoconductor in a vicinity of the cleaning position until the cleaning member reaches the cleaning position; and mounting the cleaning member at the cleaning position after the cleaning member has reached the cleaning position.

8. The manufacturing method of claim 7, further comprising applying a lubricant to a portion of the cleaning member that faces the photoconductor when the cleaning member is at the cleaning position before the moving of the cleaning member.

9. A developing unit comprising:

a photoconductor movable in an operating direction;

a cleaning member cleaning the photoconductor at a cleaning position; and a structure guiding the cleaning member toward the cleaning position in a direction that is substantially the same as the operating direction of the photoconductor in a vicinity of the cleaning position until the cleaning member reaches the cleaning position, wherein the structure comprises a frame on which the photoconductor and the cleaning member are mounted, the frame being configured so that in a process of mounting the cleaning member on the frame, the cleaning member is guided toward the cleaning position in the direction that is substantially the same as the operating direction of the photoconductor in the vicinity of the cleaning position until the cleaning member reaches the cleaning position.

10. The developing unit of claim 9, wherein the structure guides the cleaning member toward the cleaning position during manufacturing of the developing unit.

11. An image forming device comprising the developing unit of claim 9.

12. A developing unit comprising:

a photoconductor movable in an operating direction;

a cleaning member cleaning the photoconductor at a cleaning position; and a structure guiding the cleaning member toward the cleaning position in a direction that is substantially the same as the operating direction of the photoconductor in a vicinity of the cleaning position until the cleaning member reaches the cleaning position, wherein the structure comprises:

a first frame on which the photoconductor is mounted;

a second frame on which the cleaning member is mounted;

a guide pin on one of the first frame and the second frame; and a guide groove in another one of the first frame and the second frame;

wherein the first frame and the second frame are coupled together; and wherein in a process of coupling the first frame and the second frame together, the guide groove receives the guide pin to guide the cleaning member toward the cleaning position in the direction that is substantially the same as the operating direction of the photoconductor in the vicinity of the cleaning position until the cleaning member reaches the cleaning position.

13. The developing unit of claim 12, wherein the first frame and the second frame are rotatably coupled together.

14. A developing unit comprising:

a photoconductor movable in an operating direction;

a cleaning member cleaning the photoconductor at a cleaning position; and a structure guiding the cleaning member toward the cleaning position in a direction that is substantially the same as the operating direction of the photoconductor in a vicinity of the cleaning position until the cleaning member reaches the cleaning position, wherein the structure comprises a first frame on which the photoconductor is mounted; and a second frame on which the cleaning member is mounted;

wherein the first frame and the second frame are coupled together; and wherein the first frame and the second frame are configured so that in a process of coupling the first frame and the second frame together, the cleaning member is guided toward the cleaning position in the direction that is substantially the same as the operating direction of the photoconductor in the vicinity of the cleaning position until the cleaning member reaches the cleaning position.

15. A manufacturing method of a developing unit comprising a photoconductor, a roller disposed adjacent to the photoconductor, a cleaning member disposed at a cleaning position in a radial direction of the photoconductor to clean the photoconductor, and a frame on which the photoconductor, the roller, and the cleaning member are mounted, the manufacturing method comprising:

mounting the photoconductor and the roller on the frame to rotate in respective operating directions; and mounting the cleaning member on the frame so that the cleaning member is moved in a direction that is substantially the same as the operating direction of the photoconductor and then disposed at the cleaning position;

wherein:

a lubricant applied to the cleaning member adheres to the photoconductor when the cleaning member is being disposed at the cleaning position; and the lubricant adhered to the photoconductor is cleaned from the photoconductor by the cleaning member as the photoconductor rotates in the operating direction before the lubricant adhered to the photoconductor can adhere to the roller.

16. A developing unit comprising:

a photoconductor rotatable in an operating direction;

a roller disposed adjacent to the photoconductor;

a cleaning member disposed at a cleaning position in a radial direction of the photoconductor to clean the photoconductor; and a guiding part guiding the cleaning member so that the cleaning member is moved in a direction that is substantially the same as the operating direction of the photoconductor and then disposed at the cleaning position;

wherein:

a lubricant applied to the cleaning member adheres to the photoconductor when the cleaning member is being disposed at the cleaning position; and the lubricant adhered to the photoconductor is cleaned from the photoconductor by the cleaning member as the photoconductor rotates in the operating direction before the lubricant adhered to the photoconductor can adhere to the roller.

* * * * *